US007264586B2

(12) United States Patent
Mackin et al.

(10) Patent No.: US 7,264,586 B2
(45) Date of Patent: Sep. 4, 2007

(54) PRE-WARM FUNCTION FOR INFANT WARMER

(75) Inventors: Michael H. Mackin, Ellicott City, MD (US); Kathleen P. Martin, Superior Township, MI (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 11/299,499

(22) Filed: Dec. 12, 2005

(65) Prior Publication Data

US 2007/0135675 A1 Jun. 14, 2007

(51) Int. Cl.
*A61G 11/00* (2006.01)

(52) U.S. Cl. ..... 600/22

(58) Field of Classification Search ..... 600/21, 600/22; 128/205.26; 5/600, 603
See application file for complete search history.

(56) References Cited

U.S. PATENT DOCUMENTS 2,539,900 A * 1/1951 Duffy ..... 600/22
3,076,451 A * 2/1963 Stoner ..... 600/22
5,162,038 A 11/1992 Wilker
5,817,003 A 10/1998 Moll et al.
6,290,643 B1 * 9/2001 Falk et al. ..... 600/22
6,506,147 B2 1/2003 Eustace et al.
6,641,521 B2 11/2003 Kolarovic
6,733,437 B2 * 5/2004 Mackin et al. ..... 600/22
6,761,682 B2 7/2004 Goldberg et al.

* cited by examiner

*Primary Examiner*—Samuel G Gilbert
(74) *Attorney, Agent, or Firm*—Roger M. Rathbun

(57) ABSTRACT

An infant warmer for supporting an infant upon an infant platform. A radiant heater is located above the infant platform to direct infrared energy toward an infant positioned upon the infant platform. There is a pre-heat cycle that is carried out by a controller of the radiant heater that may be activated, manually or automatically, at the start-up of the infant warmer. The pre-warm cycle then warms the infant platform as well as other surfaces in close proximity thereto in order to heat those components prior to the infant being placed on the infant platform. The pre-warm cycle continues until those components are sufficient heated whereupon a signal, audible, visual or both, alerts the user that the pre-heat cycle has been completed and the infant warmer is ready to receive the infant. By warming those components, the possibility of hypothermia of the infant is reduced.

20 Claims, 2 Drawing Sheets

PRE-WARM FUNCTION FOR INFANT WARMER

BACKGROUND

The present invention relates to an infant warming apparatus and, more particularly, to an infant warming apparatus having a pre-warm function that precedes the use of the apparatus in warming an infant.

In the care of newborn infants, there are various types of apparatus that provide heat to an infant and such apparatus can include infant incubators, infant warmers and combinations of the two. In such apparatus, there is normally provided, an infant platform on which the infant is positioned so as to receive the care and that infant platform is a generally planar surface located so as to underlie the infant.

With infant warmers, there is also an overhead radiant heater that can be energized to direct energy in the infrared spectrum toward an infant resting on the infant platform to warm the infant whereas, with infant incubators, there is normally provided an infant compartment that surrounds the infant and which can thereby form an enclosed area where the infant can reside. The atmosphere within the infant compartment is controlled by means of a control of the heat and possibly humidity so as to create a beneficial atmosphere for the wellbeing of the infant.

In the control of the atmosphere within the infant compartment of an infant incubator, normally there is a convective heating system that provides warmed air to the infant compartment and the control of the temperature of the warm air utilizes an air temperature sensor that is located within or proximate to the infant compartment. A heating algorithm carried out by a controller normally uses that air temperature sensor to control the convective heating system to provide the air at the desired temperature into the infant compartment.

An infant warmer is shown and described in U.S. Pat. No. 5,474,517 of Falk et al as prior art to that patent; an infant incubator is shown and described in U.S. Pat. No. 4,936,824 of Mackin et al and a combination apparatus that combines the functions of both an infant warmer and an infant incubator is shown and described in U.S. Pat. No. 6,224,539 of Jones et al.

One of the problems with an infant warmer is that the infant is normally placed on the infant platform that is at room temperature and thus there is an initial cooling of the infant until the radiant heater can take effect and warm the infant as well as the surfaces and materials surrounding the infant. With the use of an infant incubator, there has been proposed a pre-warm function in U.S. Pat. No. 5,817,003 of Moll et al and that pre-warm function is based on the continual monitoring of the air temperature within the infant compartment such that the pre-warm function can readily be terminated when the internal air temperature of the infant compartment reaches a predetermined temperature. However, the presence of the air temperature sensor within or in close proximity to the infant compartment in an infant incubator facilitates the control and timing of the pre-warm cycle and the air temperature within the infant compartment also provides a good indication of the temperature of the various air ducting and passageways of the conductive heating system.

In addition, with an infant incubator, the infant compartment is a confined, isolated environment and therefore is not greatly affected by factors such as the surrounding external environment, i.e. temperature, room air velocity or other factors such as supply voltage.

On the other hand, an infant warmer is affected by such conditions and moreover, an infant warmer does not have an air temperature sensor located in the vicinity of the infant and, therefore, there is no simple solution to controlling the use of a pre-warm function of an infant warmer. Accordingly, simply because the use of a pre-warm cycle may be present or disclosed for use with an infant incubator does not give rise to a easy transfer of that function or cycle for use with an infant warmer, despite the fact that the presence of a pre-warm cycle would also be advantageous with an infant warmer.

SUMMARY OF THE INVENTION

Accordingly, the present invention relates to an infant warmer that includes a base with an infant platform on the base for providing a support for an infant receiving care. The infant warmer includes an overhead radiant warmer that directs infrared radiation toward the infant platform in order to heat the infant supported thereon.

As such, the radiant heater is energized to provide the infrared energy and de-energized when the heating of the infant is discontinued. In the normal warming of an infant, there is an infant heating cycle that is carried out by a controller that may respond, for example, to a patient skin temperature sensor in carrying out that heating function. The controller determines the energization and de-energization of the radiant heater and, as a function of the controller, there is a pre-warm cycle, in addition to the normal infant heating cycle, that may be activated by the user in the initial start-up of the apparatus and which energizes the radiant heater prior to placing the infant on the infant platform. Thus, during the pre-warm cycle, the radiant warmer serves to heat the infant platform as well as other surfaces that are impinged upon by the infrared energy when the infant is not present and, during the normal infant heating cycle, the controller carries out the normal heating of the infant with the infant positioned on the infant platform.

When the surface of the infant platform and other surfaces have been warmed to the desired temperature, the infant can be placed on the infant platform and the potential of hypothermia is reduced by the infant now being placed on, and surrounded by, warmed surfaces instead of the otherwise ambient temperature surfaces and materials. The length of time that the pre-warm cycle can be activated can be determined by a timer or other control scheme that is independent of the air temperature surrounding the infant.

With the above, a pre-warm cycle can be used with an infant warmer where there is no air temperature sensor located proximate to the infant or even within an infant compartment and yet the radiant heater can be energized upon activation of the infant warmer for a period of time prior to placing the infant onto the infant platform such that the platform itself as well as the surrounding surfaces are pre-warmed to reduce the possibility of hypothermia.

The pre-warm cycle can be controlled in a number of ways. It may be initiated when the warmer itself is activated such that the pre-warm cycle can be automatically initiated at each start up of the infant warmer itself. Alternatively, the per-warm cycle can be initiated by the user choosing to start up the infant warmer in the pre-warm cycle such that the user initiates the pre-warm cycle. As a still further alternative, there may be a timer that starts up the infant warmer in the pre-warm cycle if the radiant heater has been deactivated for a predetermined minimum time and not initiate the pre-warm cycle if the radiant heater has been deactivated for only a maximum period of time. With the former, it is assumed that the infant platform and surrounding surfaces may have cooled to the point that the pre-warm cycle is needed, and with the latter, it is assumed that the infant platform and surrounding surfaces are still sufficiently warm from the prior activation of the radiant warmer that the pre-warm cycle is not necessary.

As a further alternate embodiment, there may be an infant sensor that senses when the infant is present on the infant platform and sends a signal to the controller indicating that the infant is present. Upon receipt of that signal, the controller recognizes the presence of the infant and, if that signal occurs at the initial start up of the warmer, the controller can immediately go into the normal infant heating cycle and thus skip the pre-warm cycle. In the event the infant senses the presence of the infant during the pre-warm cycle, such as when the user places the infant on the infant platform during the pre-warm cycle, the controller can, again in response to the recognition of the infant's presence, immediately terminate the pre-warm cycle and go into the normal infant heating cycle.

These and other features and advantages of the present invention will become more readily apparent during the following detailed description taken in conjunction with the drawings herein.

DETAILED DESCRIPTION OF THE INVENTION

Figure 1:
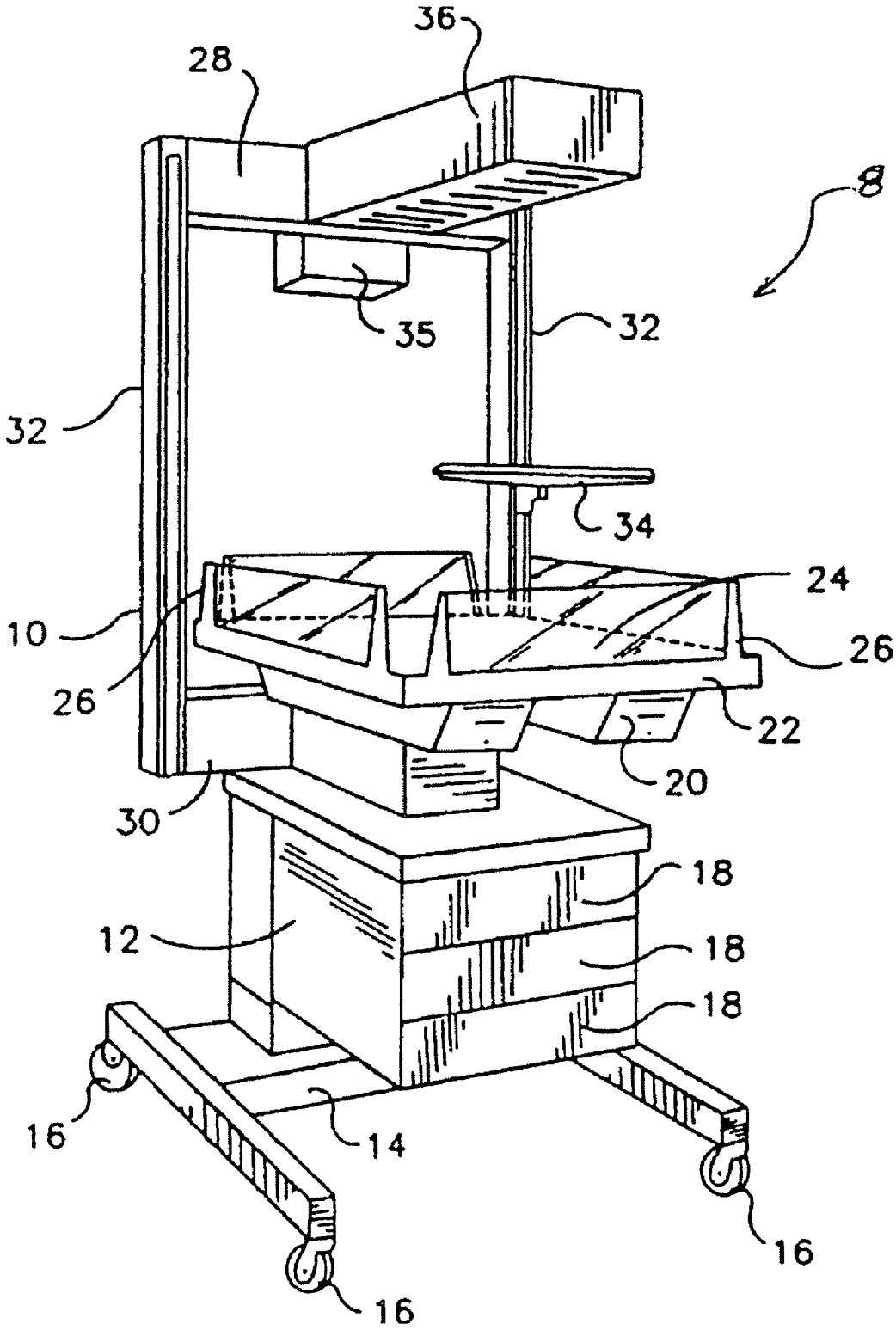
FIG. 1 is a perspective view of an infant warmer for carrying out the present invention.

Referring now to FIG. 1, there is shown a perspective view of an infant warmer 8. As shown, the infant warmer 8 includes a frame 10 that provides a free standing unit for the infant warmer 8. The frame 10 is supported upon a cabinet 12 which, in turn, is mounted upon a base 14 having wheels 16 so that the infant warmer 8 is easily movable. The cabinet 12 may also include one or more drawers 18 for containing items for attending to the infant.

An infant pedestal 20 is mounted atop of the cabinet 12 and on which is located an infant platform 22 which underlies an infant positioned thereon. Pedestal 20 is the main support for infant platform 20. The infant platform 22 has a generally planar upper surface 24 with appropriate cushioning material for comfort of the infant and further may be surrounded by guards 26, generally of a clear plastic material, and which contain the infant on the upper surface 24. Generally, the guards 26 are removable and/or releasable for complete access to the infant.

Frame 10 includes upper and lower cross members 28 and 30, respectively, joining a pair of vertical struts 32 and which vertical struts 32 may provide a means of support for other structural parts such as a shelf 34.

Mounted on the upper cross member 28 may be a control module 35 for containing the various electrical controls to operate the infant warmer and the control module 35 includes a controller 37, such as a microprocessor, that is employed to carry out the steps of the present invention that will be later described. A radiant heater 36 is mounted to the upper cross member 28 to direct the infrared radiation towards the infant platform 22.

As will be noted, the location of the radiant heater 36 is such to be above the infant platform 22. The radiant heater 36 is focused so as to provide a footprint on and around the infant to optimize the amount of heat directed upon the infant. Various types of focusable heaters are available for such application, examples of which may be a Calrod focused heater of about 500-600 watts or a corrugated foil heater. Preferably, the latter is of a linear length such that the footprint of heat at the infant platform 22 is generally rectangular.

Typically, the radiant heater 36 is about 18 to 24 inches in length extending outwardly, cantilever fashion from the cross member 28 and will contain therein, the Calrod resistance heater that is enclosed within a glass tube. Also within the heater 36 is a parabolic metal reflector that redirects the infrared radiation emanating in all directions from the Calrod resistance heater downwardly towards the infant platform 22. The parabolic reflector and Calrod heater are not shown but are conventional in such currently available infant care centers.

As a further alternative, the radiant heater can be of the design and shape as shown and described in U.S. Pat. No. 6,245,010 of Thomas Jones and entitled Radiant Heater For Infant Warmers where the heater can be in the shape of a parabaloid, hyperboloid or ellipsoid.

There is also present an infant sensor 39 located on or proximate to the infant platform 22 and which senses the presence of the infant when positioned on the infant platform 22. The infant sensor 39 senses when there is an infant present on the infant platform 22 and sends a signal indicative of that event. The infant sensor 39 may be any of a variety of sensors, including a sensor that is sensitive to the weight of an infant resting on the infant platform 22, a motion sensing sensor or other device that senses when the infant is present on the infant platform 22. The purpose of the infant sensor 39 will be later explained.

Thus far, with the exception of the infant sensor 39, there has been described a typical infant warmer basically comprising the infant platform 22 with a radiant heater 36 located above that infant platform that directs infrared energy towards the infant platform 22 to impinge upon an infant, when present, to warm that infant. As will be seen, however, the present invention can be used with a conventional infant warmer, as herein described, or with any modified or new infant warmer to provide a unique feature to the infant warmer.

Figure 2:
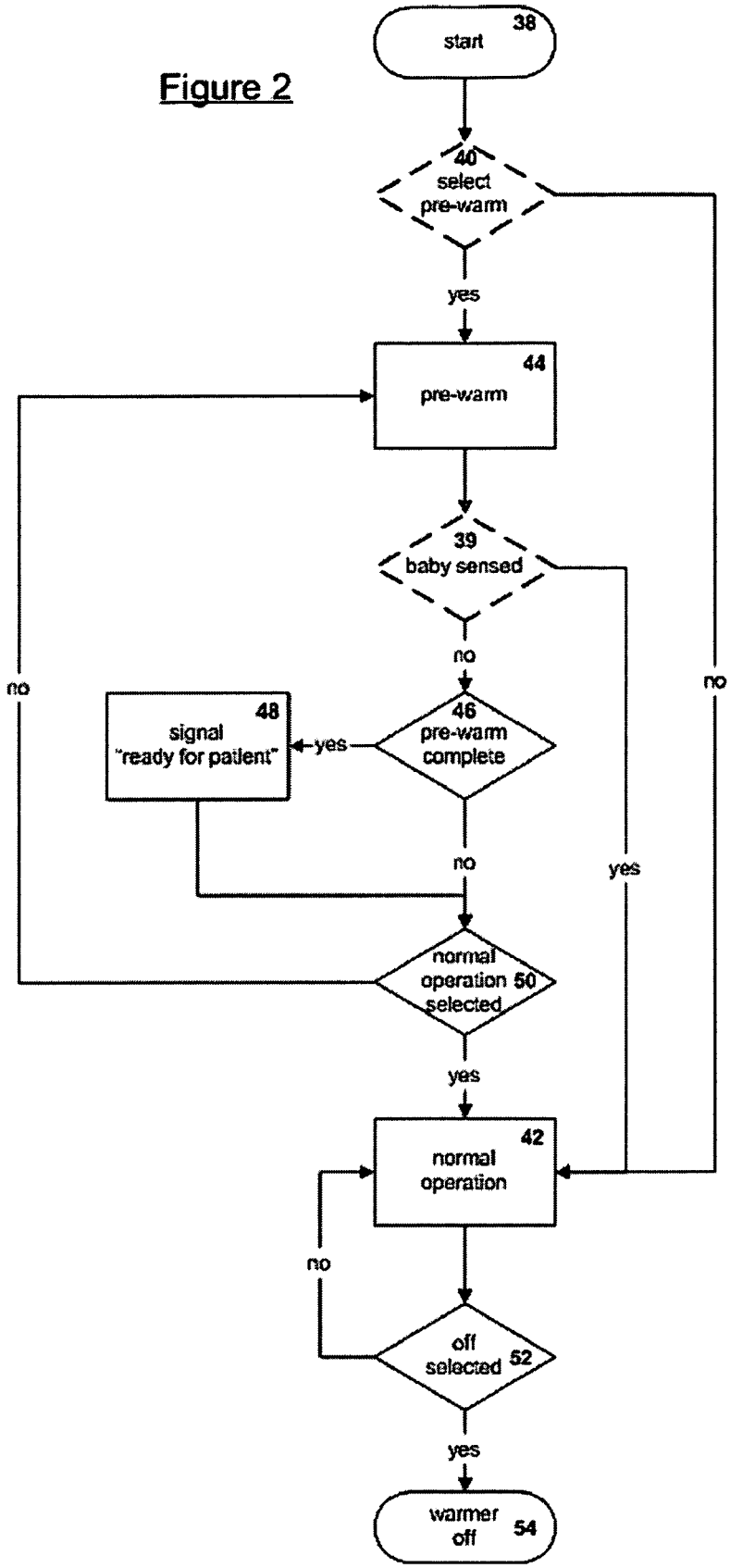
FIG. 2 is a flow chart illustrating the pre-warm cycle of the present invention.

Accordingly, turning now to FIG. 2, taken along with FIG. 1, there is shown a flow chart that sets forth the steps of the pre-warm cycle of the present invention. Taking the steps of the flow chart, initially the infant warmer 8 is turned on at the start-up block 38. In the infant warmer 8, the start-up bock 38 is the initial activation of the infant warmer 8 by the user. There is a selection option at block 40 where the user may or may not select the use of the pre-warm cycle. If the pre-warm cycle option has not been selected by the user, the system immediately goes into its normal operation or heating cycle for heating the infant as depicted by the block 42 and the normal heating cycle is provided to an infant being cared for by the infant warmer 8.

If, on the other hand, the pre-warm cycle has been selected at block 40, the system initiates the pre-warm cycle, at block 44 and the radiant heater 36 begin to pre-warm the components of the infant warmer 8. That pre-warm cycle will continue, in the absence of an infant, until the pre-warm cycle is completed, shown at 46. As such, when the pre-warm cycle is prewarmed, there is a signal, at block 48, that is activated and which may be visual, audible, or both, that alerts the user that the pre-warm cycle has been completed and the infant warmer 8 is ready to receive an infant.

Thus, the system keeps the controller 37 in the pre-warm cycle until there is an infant sensed by the infant sensor 39 indicating that an infant is present on the infant platform 22. The infant may have been there initially or have been placed on the infant platform 22 during the pre-warm cycle, however, in either case, the presence of the infant immediately takes the system out of the pre-warm cycle and directly into the normal operation at 42, where the radiant heater 36 is energized to warm the now present infant through the normal heating cycle.

As a further feature there can be a selection option where the infant warmer 8 is in its pre-warm cycle, at 50, where the user can opt out of the pre-warm cycle manually, such as when an infant must be immediately placed in the infant warmer 8 despite the system still being in the pre-warm cycle. As such, the user can activate the normal operation selected option, at block 50 to cause the infant warmer 8 to again go directly into the normal operation at block 42.

Finally, as can be seen, there is a "shut off" function at block 52 that allows the user to power down the infant warmer and, when triggered, the infant warmer 8 goes into the "warmer off" status of block 54.

As a still further alternative, there may be a timer that automatically determines that the "off time" was sufficiently long that upon start-up the pre-warm cycle is automatically utilized rather than selected at block 40. Conversely if the timer determines that the "off time" was relatively short, the pre-warm cycle may be eliminated.

The pre-warm cycle of block 44 thus activates or energizes the radiant heater 36 at a time when there is no infant positioned on the infant platform 22 so that the radiant warmer 8 can heat the infant platform 22 as well as surrounding materials in close proximity to the infant to avoid cold surfaces that could cause hypothermia of the infant. The radiant warmer 36 thereafter remains on until the surfaces involved reach the desired temperature. That time period may simply be established by a timer that leaves the radiant heater 36 on for a predetermined amount of time, and, when that time has elapsed, the controller 37 activates a signal to the user, shown at block 48, either audible, visual or both, to advise the user that the surfaces are sufficient warm and that an infant can now be placed atop of the infant platform 22.

In FIG. 2, there is also shown, the optional function of the infant sensor 39. In the event the user initiates the infant warmer 8 in the pre-warm mode block 44, the controller 37 checks to see if there is a signal present from the infant sensor 39, that is, to ascertain whether there is an infant resting on the infant platform 22. If there is an infant present, the signal from the infant sensor 39 causes the controller 37 to skip the normal pre-warm cycle and proceed to the normal heating of the infant in the conventional control of the radiant heater 36.

Along with that option, in the event that the pre-warm cycle of block 44 is activated, that is, the pre-warm cycle is being carried out, the placing of an infant on the infant warmer 8 during the pre-warm cycle can also activate the infant sensor 39 to send a signal to controller 37 such that the pre-warm cycle can be immediately terminated and the normal heating cycle and function of the infant warmer 8 can be activated. With this option, therefore, the pre-warm cycle is either prevented if there is an infant present on the infant platform 22 or is terminated if an infant is later placed on the infant platform 22 during the pre-warm cycle and, in either instance, the controller 37 omits or cancels, whichever the case may be, the pre-warm cycle and establishes the normal heating function of the infant warmer 8.

Those skilled in the art will readily recognize numerous adaptations and modifications which can be made to the infant warmer of the present invention which will result in an improved heating system for an infant care apparatus, yet all of which will fall within the scope and spirit of the present invention as defined in the following claims. Accordingly, the invention is to be limited only by the following claims and their equivalents.

We claim:

1. An infant warmer comprising a base having an infant platform on which an infant is adapted to be positioned and a radiant heater positioned above the infant platform to direct infrared radiation toward the infant platform to provide heat to an infant positioned thereon, a controller for energizing and de-energizing the radiant heater, the controller being programmed to provide a pre-warm cycle to energize the radiant heater in advance of placing an infant on the infant platform for a period of time to warm the infant platform, and a signal means to alert a user when the radiant heater has been energized for a sufficient period of time during the pre-warm cycle to allow an infant be placed on the warmed infant platform.

2. The infant warmer as defined in claim 1 wherein the pre-warm cycle is activated by a control initiated by a user.

3. The infant warmer as defined in claim 1 wherein the controller includes a timer that controls the activation of the pre-warm cycle.

4. The infant warmer as defined in claim 3 wherein the controller is programmed for activating the pre-warm cycle where the radiant heater has been de-energized for a predetermined minimum period of time.

5. The infant warmer as defined in claim 3 wherein the controller is programmed for preventing the activation of the pre-warm cycle where the radiant heater has been de-energized for a maximum predetermined time.

6. The infant warmer as defined in claim 1 wherein the controller is programmed for activating the pre-warm cycle automatically upon the activation of the infant warmer.

7. The infant warmer as defined in claim 1 wherein the infant warmer further has an infant sensor that senses the presence of an infant resting on infant platform.

8. The infant warmer as defined in claim 7 wherein the controller is programmed for terminating the pre-warm cycle upon the infant sensor sensing the presence of an infant resting on the infant platform.

9. The infant warmer as defined in claim 1 wherein the infant warmer includes a user activated switch to discontinue the pre-warm cycle.

10. A method of controlling an infant warmer, said method comprising the steps of:

providing an infant warmer having a infant platform for supporting an infant and a radiant heater located above the infant platform adapted to direct infrared energy toward the infant platform, the radiant heater being energizable to emit the radiant energy and being de-energizable, the infant warmer having a pre-programmed controller;

energizing the radiant heater during a pre-warm cycle controlled by the pre-programmed controller without an infant present on the infant platform for a sufficient period of time to warm the surface of the infant platform to a desired temperature;

providing an alert controlled by the pre-programmed controller to signal a user when the pre-warm cycle has sufficiently warmed the infant platform.

11. The method as defined in claim 10 wherein the step of energizing the radiant heater during a pre-warm cycle comprises energizing the radiant warmer by means of a user input.

12. The method as defined in claim 10 wherein the step of energizing the radiant heater during a pre-warm cycle comprises automatically energizing the heater upon start-up of the infant warmer.

13. The method as defined in claim 10 wherein the step of energizing the radiant heater during a pre-warm cycle comprises energizing the radiant heater only after a predetermined period of time subsequent to the prior energization of the radiant heater.

14. The method as defined in claim 10 wherein the method further comprises the step of sensing the presence of an infant located on the infant platform.

15. The method as defined in claim 14 wherein the step of sensing the presence of an infant further includes the step of interrupting the pre-warm cycle when the presence of an infant is sensed.

16. An infant warmer comprising a base having an infant platform on which an infant is adapted to be positioned and a heater positioned to direct infrared radiation toward the infant platform to provide heat to an infant positioned thereon, a controller programmed for energizing and de-energizing the heater, said controller further programmed with an infant heating cycle for providing heat to an infant resting on the infant platform and a pre-warm cycle to energize the radiant heater in advance of placing an infant on the infant platform for a period of time to warm the infant platform, and an infant sensor to provide a signal to the controller when an infant is resting on the infant platform, wherein said controller, upon receipt of the signal from the infant sensor is programmed for initiating the infant heating cycle.

17. The infant warmer of claim 16 wherein the controller is programmed for terminating the pre-warm cycle and initiating the infant heating cycle when said infant sensor provides said signal to the controller.

18. The infant warmer of claim 16 wherein the controller is programmed for preventing the initiation of the pre-warm cycle when said infant sensor provides said signal to the controller.

19. The infant warmer of claim 16 wherein the infant sensor is a motion sensor to detect the presence of an infant resting on the infant platform.

20. The infant warmer of claim 16 wherein the infant warmer includes a user operated switch that can be activated to interrupt the pre-warm cycle and initiate the infant heating cycle.

* * * * *